US005899422A

United States Patent [19]

Eke

[11] Patent Number: 5,899,422

[45] Date of Patent: May 4, 1999

[54] ADJUSTABLE FURNITURE LEG EXTENSION

[75] Inventor: Alan Eke, Blaine, Minn.

[73] Assignee: Roman Wieland, Cottage Grove, Minn.

[21] Appl. No.: 08/844,402

[22] Filed: Apr. 18, 1997

[51] Int. Cl.[6] ..... F16M 11/24

[52] U.S. Cl. ..... 248/188.4; 248/188.7; 108/144.1; 16/32

[58] Field of Search ..... 248/188, 188.2, 248/188.3, 188.4, 188.7, 188.8, 188.91, 502, 501, 346.04, 346.05, 648, 649, 650; 297/344.12; 108/144.1; 16/32, 42 B, 42 T

[56] References Cited

U.S. PATENT DOCUMENTS

| | | | |
|---|---|---|---|
| Re. 18,647 | 11/1932 | Phillips | 248/188.2 |
| 400,033 | 3/1889 | Alliger | 248/188.2 |
| 453,649 | 6/1891 | Lindsey | 248/188.2 |
| 575,806 | 1/1897 | Garvey | 248/188.2 |
| 878,043 | 2/1908 | Chrisman | 248/616 |
| 1,230,187 | 6/1917 | McClelland | 248/188.2 |
| 1,272,636 | 7/1918 | Dittrick | 248/188.2 |
| 1,394,631 | 10/1921 | Luschka et al. | 248/650 |
| 1,399,623 | 12/1921 | Hunt | 248/188.2 |
| 1,549,144 | 8/1925 | Messegee | 248/188.2 |
| 1,798,272 | 3/1931 | Phillips | 248/188.2 |
| 2,072,791 | 3/1937 | Baer | 5/11 |
| 2,107,629 | 2/1938 | Dallas | 248/188.2 |
| 2,366,867 | 1/1945 | Nichthauser | 248/188.2 |
| 2,392,527 | 1/1946 | Divil | 248/188.2 |
| 2,599,020 | 6/1952 | Safstrom | 108/144 |
| 2,633,898 | 4/1953 | Worgan | 248/188.2 |
| 2,722,970 | 11/1955 | Stechmann | 248/188.2 |
| 2,750,709 | 6/1956 | Saverino | 248/188.2 |
| 2,780,507 | 2/1957 | Farley | 248/188.2 |
| 2,893,164 | 7/1959 | Martin | 248/188.2 |
| 2,933,850 | 4/1960 | Martin | 248/188.2 |
| 2,935,813 | 5/1960 | Berman et al. | 248/188.2 |
| 2,941,329 | 6/1960 | Apparius | 248/188.2 |
| 3,215,382 | 11/1965 | Stein | 248/188.2 |
| 3,232,253 | 2/1966 | Winters | 248/188.2 |
| 3,295,802 | 1/1967 | Leatherman | 248/44 |
| 3,952,983 | 4/1976 | Crochet | 248/173 |
| 4,117,999 | 10/1978 | Gessler | 248/188.2 |
| 4,919,386 | 4/1990 | Cassina | 248/544 |
| 5,060,896 | 10/1991 | Hobbins | 248/188.2 |
| 5,107,775 | 4/1992 | Langlais et al. | 108/144 |
| 5,199,122 | 4/1993 | Styblo | 5/509.1 |
| 5,224,227 | 7/1993 | McGinley | 5/509.1 |
| 5,333,825 | 8/1994 | Christensen | 248/188.2 |

*Primary Examiner*—Ramon O. Ramirez
*Assistant Examiner*—Gwendolyn Baxter
*Attorney, Agent, or Firm*—Gregory P. Kaihoi

[57] ABSTRACT

An adjustable furniture leg extension device for use in raising the height of a piece of furniture, such as a chair, table or bed. The device includes a base having a bottom surface for resting on a floor, and an adjustable support member received within the base. The support member includes an upper load-bearing surface on which the furniture leg may rest. A generally rigid stabilizing arm extends laterally from the base and includes a stabilizing foot having a bottom surface which is generally co-planar with the bottom surface of the base. The adjustable support member may include a rim extending upwardly from an edge of the load-bearing surface, the rim serving to help retain the furniture leg on the load-bearing surface. One such leg extension device is placed beneath each leg of the furniture item to be raised, with the respective stabilizing arms turned inwardly beneath the furniture item. The stabilizing arms of the extension devices may be connected to each other by a tether such as a rope or bungee cord.

23 Claims, 3 Drawing Sheets

ADJUSTABLE FURNITURE LEG EXTENSION

TECHNICAL FIELD

The invention relates to devices for extending the legs of furniture to make use of the furniture more convenient.

BACKGROUND OF THE INVENTION

Many elderly people have difficulty getting up from chairs, beds, sofas, etc. that sit too low to the ground. For such people the ability to dependably use the furniture in their homes can be critical to maintaining their independence. That is, for many such people, except for the difficulty in using their furniture they would be entirely capable of living in their homes. Because, however, such persons often cannot reliably get up out of a bed or a chair that sits too low to the ground, they often are unable to continue living in their homes with their existing furniture.

Several options become available in such situations. In some cases, the person is forced to move to some type of assisted living quarters, usually at significant expense and with personal dislocation. Another option is to replace the too-low furniture with taller furniture (or with furniture having remote control adjustments to help stand the person up); this, too, can involve considerably expense, and involves significant change that can be quite disruptive to many elderly people. Yet another option is to modify their existing furniture to make it taller. Usually it is difficult to actually replace furniture legs with longer legs. Modifications thus typically must be accomplished by extending the length of the existing furniture legs. Because of the variety of types and styles of furniture legs, such modifications are not easily accomplished. Moreover, to make sure that the extended legs are sturdy, leg extensions must be firmly secured to the existing legs. On a piece of fine furniture, this often can cause permanent damage or disfigurement to the piece of furniture.

A variety of furniture leg extenders have been proposed in an attempt to deal with the above problems. For example, U.S. Pat. No. 2,072,791 (Bear) depicts the use of an adjustable bed elevating device under each of the four legs of a bed. Each device consists of a round base supporting a set of generally vertical telescoping tubes, on top of which is mounted a circular cup. The cup is large enough to hold the castor wheel of a typical bed frame leg. While Baer's elevating devices do raise the bed significantly, they have limited stability because they are not secured in any way to the legs or frame of the bed (or to each other) and they are substantially taller than they are wide. Thus, if one "fell" into the bed, it could easily be rocked off of the leg extenders (often when elderly people sit down onto a chair or bed they are not strong enough to sit down in the normal smooth, controlled fashion, but end up "falling" the last several inches into the chair or bed). Also, when one gets up out of the bed, the normal tendency (particularly for the elderly) is to push not only down with ones hands but also backward, thus again creating a situation where the bed could easily be rocked off of the leg extenders.

U.S. Pat. No. 5,060,896 (Hobbins) depicts the use of four individual leg extenders on a chair having four generally straight legs. Each of Hobbins' leg extenders includes an elongated tubular member. The bottom of the chair leg rests on a support member extending out laterally from the tubular member. A portion of the tubular member extends upwardly along one or two sides of the chair leg, this portion of the tubular member being strapped tightly onto the leg to provide a secure connection between the leg and the leg extender. In order for this connection to be secure, however, the chair leg must have a generally constant external shape (e.g., square or round)—otherwise the fit between the chair leg and the leg extender would be loose and not entirely stable. Thus, Hobbins' device would not work well on a leg that has a castor or any significant curve near its bottom end (e.g., cabriole leg or legs with rims, ridges, fancy turnings or even a simple taper). Hobbins' device also depends heavily on the strength and rigidity of the strap securing the device to the leg—if the strap stretches or loosens, the weight of the chair (and the person sitting on it) will tend to urge the leg to slip off of the support member.

Several other inventors have attempted to solve the stability problems noted above by providing rigid mechanical connections among each of the four leg extenders used to raise chair. Examples of these proposed solutions are found, e.g., in U.S. Pat. Nos. 3,215,382 (Stein), 3,952,983 (Crochet) and 5,333,825 (Christensen). Because different pieces of furniture have different leg spacing, however, these structures require some type of adjustment system to permit alignment of each of the leg extenders with its respective leg while nevertheless maintaining a rigid connection among the leg extenders. The adjustment mechanisms therefore provide significant extra weight and complexity to the device, and can be very cumbersome. Moreover, to prevent their adjustment mechanisms and connections from becoming overly heavy and cumbersome, they typically are designed only for use with furniture having legs spaced relatively closely together (i.e., typically just chairs).

SUMMARY OF THE INVENTION

The invention provides an adjustable furniture leg extension device which is easily adapted for use in raising the height of a piece of furniture, such as a chair, table or bed. The device includes a base having a bottom surface for resting on a floor, and an adjustable support member received within the base. The support member includes an upper load-bearing surface on which the furniture leg may rest. A generally rigid stabilizing arm extends laterally from the base and includes a stabilizing foot having a bottom surface which is generally co-planar with the bottom surface of the base. The stabilizing foot is located a distance, measured laterally from the center of the load-bearing surface, of at least about twice the nominal width of the load-bearing surface. Preferably the adjustable support member includes a rim extending upwardly from an edge of the load-bearing surface, the rim serving to help retain the furniture leg on the load-bearing surface.

One such furniture leg extension device is placed beneath each leg of a piece of furniture, preferably with the laterally extending stabilizing arm extending inwardly (i.e., toward the center of the piece of furniture), so as to be out of the way. The stabilizing arms of the extension devices may be connected to each other by a tether (such as a rope or bungee cord). Optional fasteners (such as strips of hook and loop type fasteners) may be used to secure each leg extension device to the furniture leg.

DETAILED DESCRIPTION OF THE INVENTION

Figure 1:
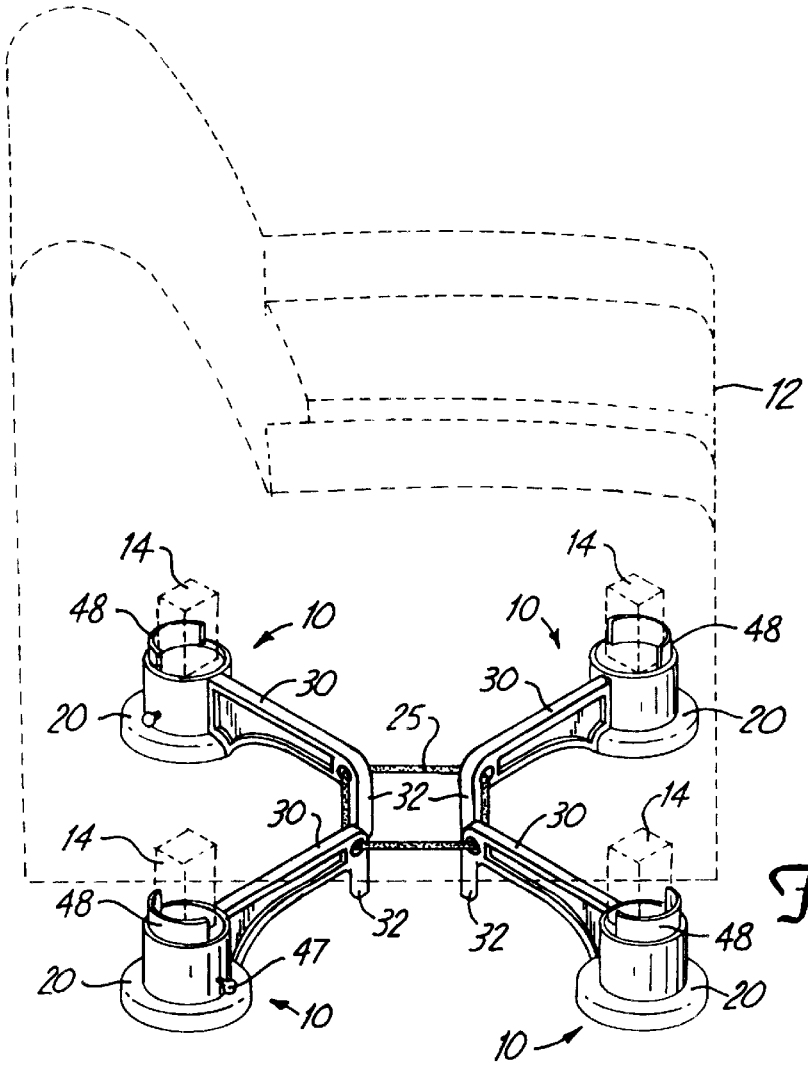
FIG. 1 is a perspective view of a chair (shown in phantom lines) supported by a set of four adjustable furniture leg extension devices of the invention.

FIG. 1 depicts a typical application of the adjustable furniture leg extension device 10 of the invention to raise the height of a chair 12 having four legs 14, each leg resting on the load-bearing surface 42 of the leg extension device 10. It will be appreciated that while FIG. 1 illustrates use of the invention in connection with a chair 12, the invention is also suitable for use in raising the height of other types of furniture, such as beds, tables, desks, etc.

Figure 2:
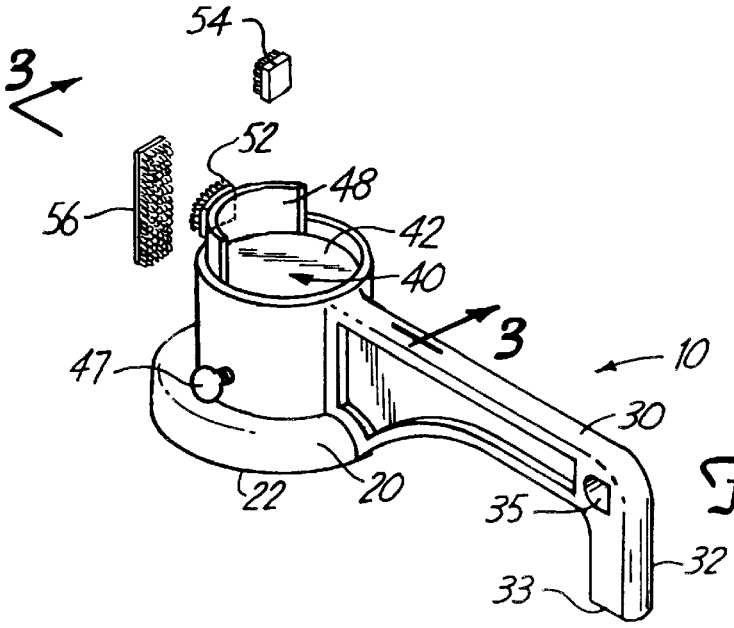
FIG. 2 is a perspective view of a single adjustable furniture leg extension device of the invention.
Figure 3:
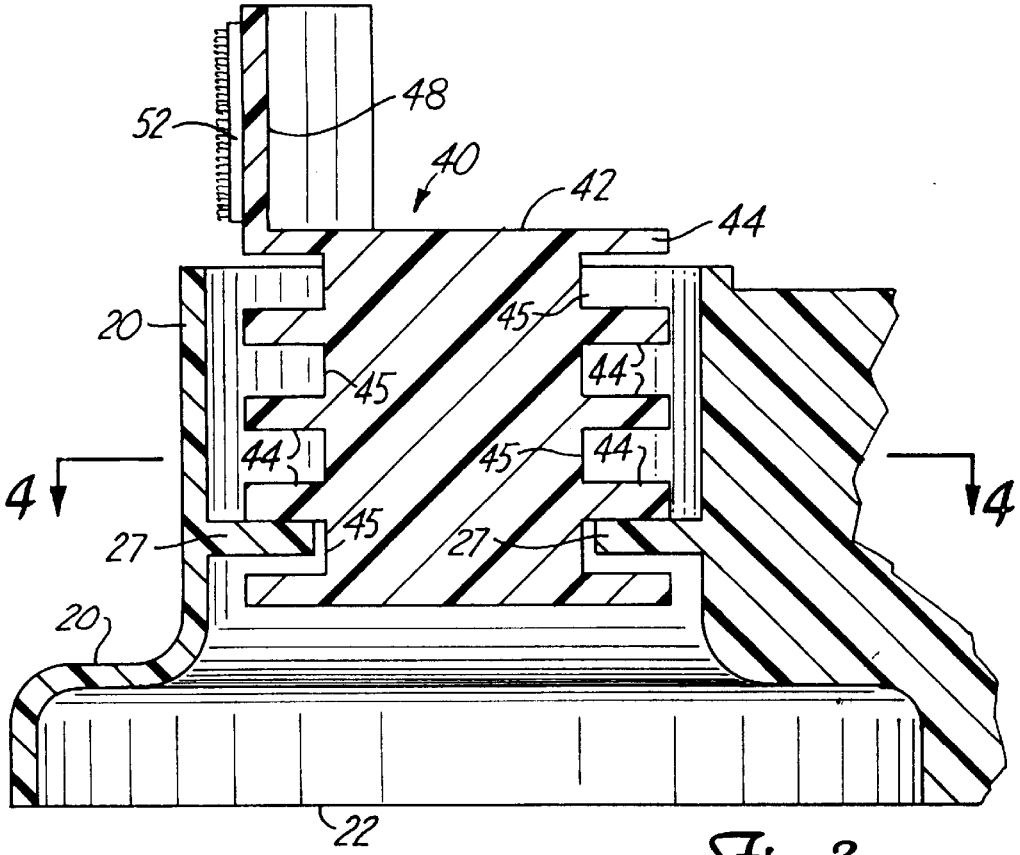
FIG. 3 is a cross-sectional, partially broken-away view of FIG. 2, taken along lines 3—3 thereof.
Figure 4:
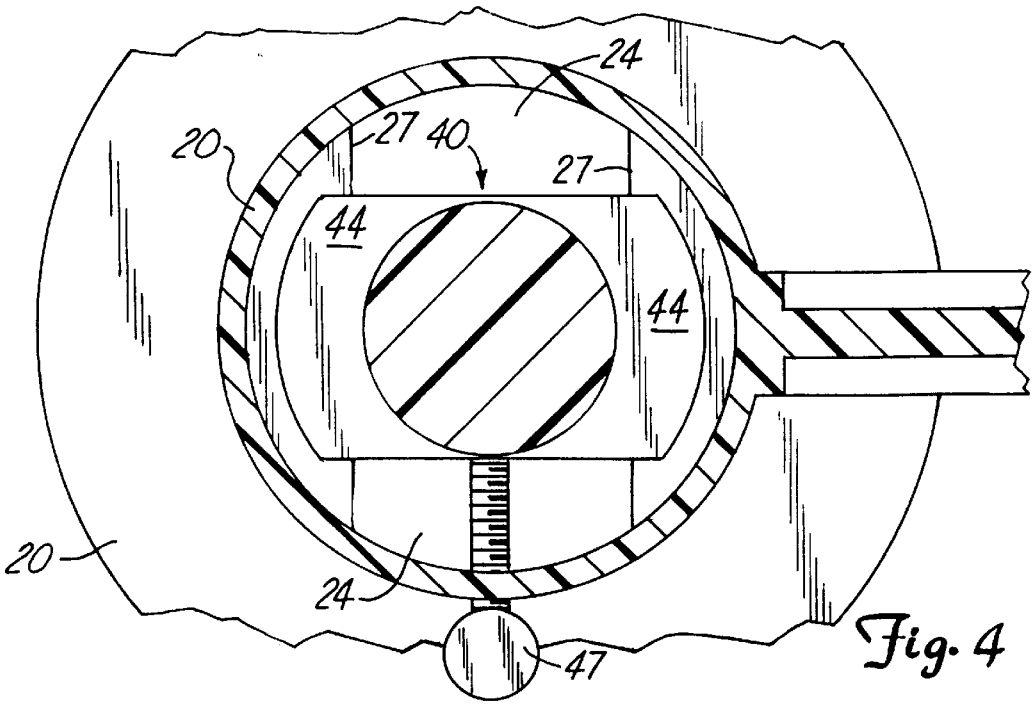
FIG. 4 is a cross-sectional view of FIG. 3, taken along lines 4—4 thereof.

Details regarding the structure and configuration of the furniture leg extension device of the invention are illustrated in FIGS. 2–4. The device includes a base 20 having a bottom surface 22 which rests on the floor. A generally rigid stabilizing arm 30 extends laterally from the base 20 and includes a stabilizing foot 32 having a bottom surface 33 which is generally co-planar with the bottom surface 22 of the base 20. The stabilizing arm 30 and foot 32 are provided to give lateral stability to the device—i.e., sufficient stability to substantially prevent the device from easily tipping over under normal use conditions (which may include, as indicated above, situations where a person essentially "falls" into the chair or bed). To provide such stability, desirably the foot 32 is located a distance, measured laterally from the center of the load-bearing surface 42, of at least about twice (and preferably at least about three times) the nominal width of the load-bearing surface 42. Depending on the size of the device 10, desirably this distance is at least about six to eight inches, and preferably about 10 inches.

The furniture leg 14 rests on an upper load-bearing surface 42 of the leg extension device. While this load-bearing surface 42 may be carried directly by the base 20, preferably the load-bearing surface 42 is carried by an adjustable support member 40 received within the base 20, thereby permitting the user to conveniently adjust the amount of elevation supplied by the furniture leg extension device 10. While adjustability of the height of the load-bearing surface 42 may be accomplished in a variety of ways, in the preferred embodiment illustrated in the drawings an adjustable support 40 is provided with several radially extending flanges 44. Adjacent flanges 44 are spaced vertically from each other to form radially inwardly extending notches 45 between the flanges 44.

The base 20 includes a central cavity 24 which preferably is generally round. A flange 27 extends radially into the cavity 24, the flange 27 being sized and shaped to be engageable in the notches 45 formed between adjacent flanges 44 of the adjustable support member (see FIGS. 3–4). Although the flange 27 could extend into the cavity from just one side, for stability preferably the flange 27 extends into the cavity from two sides. The adjustable support member 40 is made to be rotatable within the base 20. FIGS. 3 and 4 show the support member 40 in its first position, in which the base flange 27 is disposed within one of the notches 45, supporting the adjustable member 40 and essentially preventing vertical movement of the adjustable member 40 with respect to the base 20. From this position the support member 40 may be rotated 90° to a second position in which the flange 27 is removed from the notch 45, thus permitting vertical movement of the adjustable support 40 member with respect to the base 20. Preferably the radially outwardly extending flanges 44 of the adjustable support member 40 have a non-circular cross-sectional profile, and the flange 27, together with the shape of the base's central cavity 24, defines a similar non-circular profile. Thus, when the support member 40 is rotated into registration with the generally vertical opening 24 defined by the flange 27, the support member can be moved upwardly or downwardly within the central cavity 24 of the base. Although the drawings illustrate one particular shape of the flanges 44 (and a corresponding shape for the flanges 27 within the cavity 24), it will be apparent that any of a variety of shapes may be utilized, permitting the adjustable support member 40 to be rotated within the cavity 24 between positions where the adjustable support member 40 is supported by the flanges 27 and positions where the adjustable support member 40 may be moved freely upwardly and downwardly to adjust the height of the furniture leg extension device 10.

A lock may be provided for selectively preventing rotation of the adjustable support member 40 (i.e., to lock the adjustable support member in its first position). While any of a variety of devices could be used for such a lock, the drawings illustrate use of a simple thumb screw 47 having a threaded shaft received through a complementary threaded hole in the wall of the base 20. Screwing the thumb screw 47 in (as is shown in FIG. 4) prevents any substantial rotation of the support member 40, and screwing the thumb screw out permits rotation of the support member 40.

Figure 5:
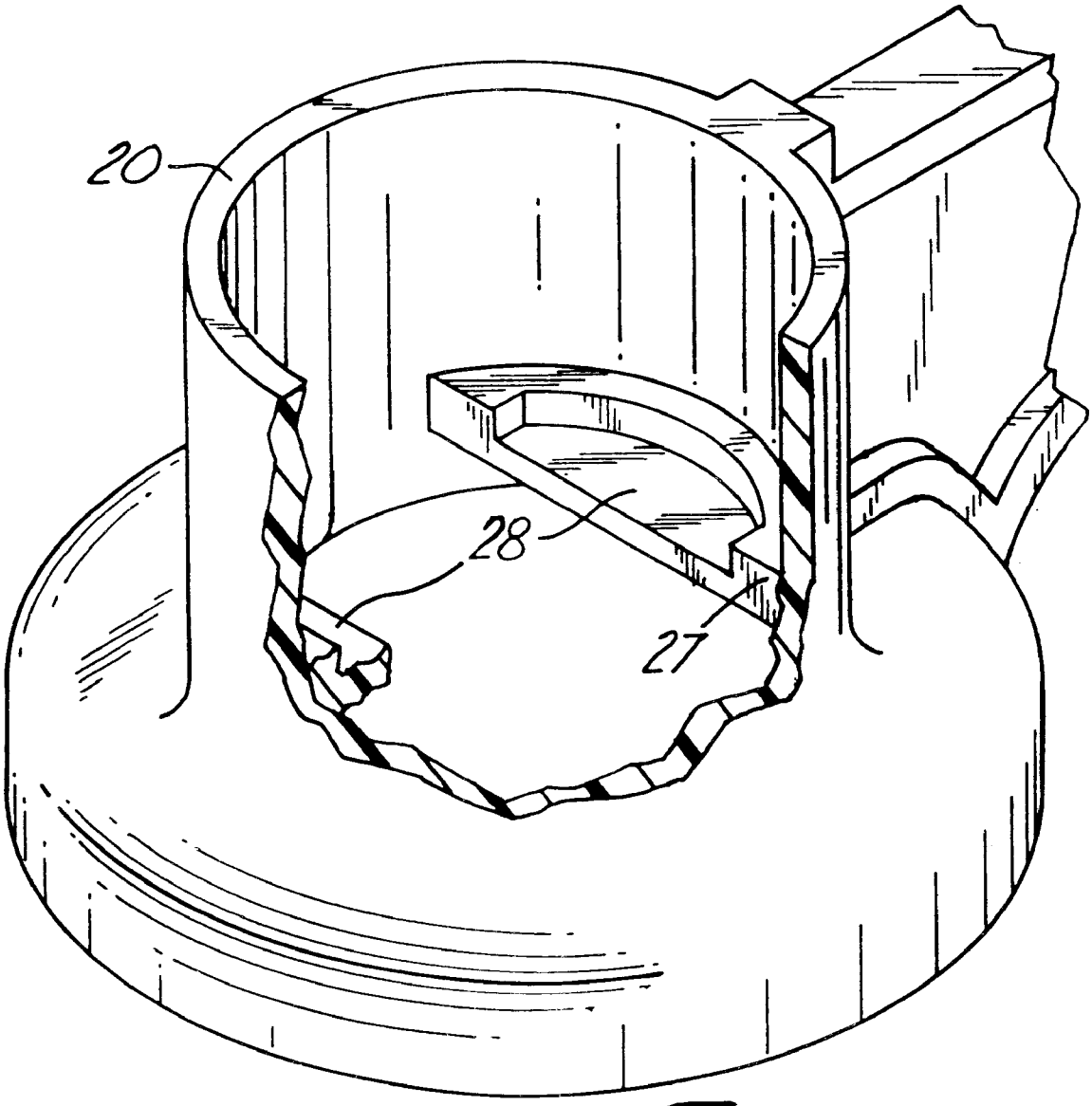
FIG. 5 is a perspective, partially broken-away view of an alternate embodiment of an adjustable furniture leg extension device of the invention.

FIG. 5 illustrates another lock for preventing rotation of the adjustable support member 40 from its first position. The lock comprises a pair of recesses 28 in the flange 27, the recesses 28 being sized and shaped to closely receive the outer portions of the flanges 44 of the adjustable support member 40. Thus, when the flanges 44 are aligned with the recesses 28, they will nest in the recesses 28; the weight of the chair (or other furniture item) effectively prevents the flanges 27 of the adjustable support member 40 from coming out of the recesses 28 in normal use, thus preventing inadvertent rotation of the adjustable support member 40.

Referring again to FIGS. 2–4, to further enhance the stability of the piece of furniture being elevated, preferably the adjustable support member 40 includes a rim 48 extending upwardly from the edge of the load-bearing surface 42. The rim serves to prevent the leg 14 of the chair (or other piece of furniture) from slipping off of the load-bearing surface 42. Although the rim 48 may extend all the way around the periphery of the load-bearing surface 42, in the preferred embodiment illustrated in the drawings the orientation of the entire device is controlled by a tether 25, so that it is only necessary for the rim 48 to extend part of the way around the load-bearing surface 42.

The tether 25 preferably is secured to the stabilizing arm 30 near the foot 32. A variety of means may be provided for this purpose, include hooks, eyebolts, and the like. In the embodiment illustrated in the drawings a recess in the form of a lateral hole 35 is integrally molded into the arm 30 near its foot 32. The tether 25 may then simply be threaded through this hole 35. Alternately the hole could also be open upwardly (in effect being a hook molded into the arm 30) so that the tether 25 could be slipped into place without having to thread it through a hole. Other suitable configurations could also be utilized. Preferably the tether 25 is a suitably sized rope or cord, which may be longitudinally elastic (such as a bungee cord).

Use of the device of the invention will be seen to be fairly straight-forward in light of the above description. When an individual determines that a particular piece of furniture—for example, a chair having four legs—should be elevated a certain distance, one furniture leg extension device is prepared for each leg. By loosening the thumb screw 47 (if such a screw is utilized—for the embodiment of FIG. 5, this step is not necessary), the adjustable support member 40 may be unlocked and rotated to the position where it may be freely moved upwardly or downwardly with respect to the base 20. When at the proper height, it is rotated to engage the base flange 27 in the corresponding notch 45 of the support member 40. In the embodiment of FIGS. 1–4 the thumb screw 47 is then tightened to lock the support member rotationally; in the embodiment of FIG. 5 the flanges 44 are simply aligned with the recesses 28 in the flanges 27 and allowed to nest within the recesses 28.

The furniture leg extension devices 10 are then placed on the floor in positions corresponding to the four legs 14 of the chair 12, with the stabilizing arms 30 directly inwardly (both so that they are out of the way and to provide suitable stability to the entire assembly). If desired, the tether 25 may then be placed in position to retain the stabilizing arms 30 directed inwardly beneath the chair. The chair is then placed on the leg extension devices, with the legs 14 properly positioned on the load-bearing surfaces 42.

If the user wishes to secure the leg extension devices 10 to the chair legs 14, a suitable attachment may be employed, such as the hook and loop fastener strips illustrated in FIGS. 1–2. In this embodiment, short strips 52 and 54 of, e.g., hooks are secured to both the base 20 and the leg 14 (e.g., using commercially available adhesive backed strips), and then a corresponding strip of loops 56 is attached to link the base 20 to the leg 14. (Obviously the hooks and loops could also be reversed.) Alternately, the hook and look fastener strips may be placed with one strip on the bottom surface of the furniture leg 14 and the complementary strip on the upper load-bearing surface 42 of the adjustable support 40. This positioning of the hood and loop strips has the advantage of not damaging the finish on the side of the furniture leg, and also provides better attachment for some kinds of furniture legs (e.g., a cabriole leg, etc.). Other suitable attachment mechanisms may also be utilized.

While a preferred embodiment of the present invention has been described, it should be understood that various changes, adaptations and modifications may be made therein without departing from the spirit of the invention and the scope of the appended claims.

What is claimed is:

1. An adjustable furniture leg extension device comprising:

a base having a bottom surface for resting on a floor;

an adjustable support member received within the base, the support member having an upper load-bearing surface on which a furniture leg may rest, the load-bearing surface having a center and a nominal width;

a generally rigid stabilizing arm extending laterally from the base and including a stabilizing foot having a bottom surface which is generally co-planar with the bottom surface of the base, the stabilizing foot being located a distance, measured laterally from the center of the load-bearing surface, of at least about twice the nominal width of the load-bearing surface.

2. The device of claim 1 wherein the stabilizing foot extends laterally from the center of the load-bearing surface a distance of at least about three times the nominal width of the load-bearing surface.

3. The device of claim 1 wherein the stabilizing foot extends laterally from the center of the load-bearing surface a distance of at least about eight inches.

4. An adjustable furniture leg extension device comprising:

a base having a bottom surface for resting on a floor;

an adjustable support member received within the base, the support member having an upper load-bearing surface on which a furniture leg may rest, the load-bearing surface having a center and a nominal width, the adjustable support member including a plurality of radially outwardly extending flanges, adjacent flanges being spaced vertically from each other to form a radially inwardly extending notch therebetween; and a generally rigid stabilizing arm extending laterally from the base and including a stabilizing foot having a bottom surface which is generally co-planar with the bottom surface of the base, the stabilizing foot being located a distance, measured laterally from the center of the load-bearing surface, of at least about twice the nominal width of the load-bearing surface.

5. The device of claim 4 wherein the base includes at least one radially inwardly extending flange engageable in at least one of the notches formed between adjacent flanges.

6. The device of claim 5 wherein the adjustable support member is rotatable within the base from a first position in which the flange is disposed within one of the notches, preventing vertical movement of the adjustable support member with respect to the base, to a second position in which the flange is removed from the notch, permitting vertical movement of the adjustable support member with respect to the base.

7. The device of claim 6 further comprising a lock positioned to selectively lock the adjustable support member against rotational movement, the lock securing the adjustable support member said first position.

8. The device of claim 7 wherein the lock comprises a threaded shaft receivable through a threaded hole in a wall of the base.

9. The device of claim 7 wherein the lock comprises one or more recesses formed in the radially inwardly extending flange of the base, such recess(es) being shaped to closely receive therein a corresponding portion of the radially outwardly extending flanges of the adjustable support member.

10. The device of claim 7 wherein the radially outwardly extending flanges of the adjustable support member have a non-circular cross-sectional profile.

11. The device of claim 10 wherein the base includes a generally vertically open central cavity, the radially inwardly extending flange of the base extending into such cavity to at least partially define an opening into which the adjustable support member may be inserted, such opening having a non-circular periphery.

12. The device of claim 11 wherein the cross-sectional profile of the adjustable support member's flanges conforms generally to the shape of the opening in the base.

13. An adjustable furniture leg extension device comprising:

a base having a bottom surface for resting on a floor;

an adjustable support member received within the base, the support member having an upper load-bearing surface on which a furniture leg may rest, the load-bearing surface having a center and a nominal width, the adjustable support member including a rim extending upwardly from the load-bearing surface; and a generally rigid stabilizing arm extending laterally from the base and including a stabilizing foot having a bottom surface which is generally co-planar with the bottom surface of the base, the stabilizing foot being located a distance, measured laterally from the center of the load-bearing surface, of at least about twice the nominal width of the load-bearing surface.

14. The device of claim 13 wherein the rim extends upwardly from an edge of the load-bearing surface.

15. The device of claim 13 wherein the load-bearing surface includes a periphery, the rim extending around only a portion of such periphery.

16. A furniture leg extension device comprising:

a base having a bottom surface for resting on a floor and an upper load-bearing surface on which a furniture leg may rest, the load-bearing surface having a center and a nominal width;

a generally rigid stabilizing arm extending laterally from the base and including a stabilizing foot having a bottom surface which is generally co-planar with the bottom surface of the base, the stabilizing foot being located a distance, measured laterally from the center of the load-bearing surface, of at least about six inches.

17. The device of claim 16 wherein the stabilizing foot extends laterally from the center of the load-bearing surface a distance of at least about eight inches.

18. The device of claim 16 further comprising means for securing the base to the furniture leg.

19. A furniture leg extension device comprising:

a base having a bottom surface for resting on a floor and an upper load-bearing surface on which a furniture leg may rest, the load-bearing surface having a center and a nominal width; and a generally rigid stabilizing arm extending laterally from the base and including a stabilizing foot having a bottom surface which is generally co-planar with the bottom surface of the base, the stabilizing foot being located a distance, measured laterally from the center of the load-bearing surface, of at least about six inches, the stabilizing arm including means for attaching a tether.

20. The device of claim 18 wherein the means for attaching a tether comprises a recess formed in the stabilizing arm and through which a tether may be threaded.

21. A furniture leg extension device comprising:

a base having a bottom surface for resting on a floor and an upper load-bearing surface on which a furniture leg may rest, the load-bearing surface having a center and a nominal width;

a generally rigid stabilizing arm extending laterally from the base and including a stabilizing foot having a bottom surface which is generally co-planar with the bottom surface of the base, the stabilizing foot being located a distance, measured laterally from the center of the load-bearing surface, of at least about six inches; and hook and loop fasteners secured to the base and the furniture leg for securing the base to the furniture leg.

22. A furniture leg extension assembly comprising a plurality of furniture leg extension devices, each extension device comprising:

a base having a bottom surface for resting on a floor and an upper load-bearing surface on which a furniture leg may rest, the load-bearing surface having a center and a nominal width; and a generally rigid stabilizing arm extending laterally from the base and including a stabilizing foot having a bottom surface which is generally co-planar with the bottom surface of the base, the stabilizing foot being located a distance, measured laterally from the center of the load-bearing surface, of at least about six inches, the stabilizing arm including attachment means for attaching a tether to the stabilizing arm; and an elongated flexible tether secured to the attachment means of each of the furniture leg extension devices to tether such devices to one another.

23. The assembly of claim 22 wherein the tether is longitudinally elastic.

* * * * *